US010844737B2

(12) United States Patent
Lauer

(10) Patent No.: US 10,844,737 B2
(45) Date of Patent: Nov. 24, 2020

(54) ADDITIVELY MANUFACTURED MODULE FOR A TURBOMACHINE

(71) Applicant: MTU Aero Engines AG, Munich (DE)

(72) Inventor: Christoph Lauer, Munich (DE)

(73) Assignee: MTU Aero Engines AG, Munich (DE)

( * ) Notice: Subject to any disclaimer, the term of this patent is extended or adjusted under 35 U.S.C. 154(b) by 20 days.

(21) Appl. No.: 16/258,953

(22) Filed: Jan. 28, 2019

(65) Prior Publication Data

US 2019/0234225 A1 Aug. 1, 2019

(30) Foreign Application Priority Data

Jan. 29, 2018 (DE) ..... 10 2018 201 295

(51) Int. Cl.
*F01D 11/00* (2006.01)
*F01D 9/04* (2006.01)

(52) U.S. Cl.
CPC ..... *F01D 11/001* (2013.01); *F01D 9/04* (2013.01); *F05D 2230/31* (2013.01); *F05D 2230/642* (2013.01); *F05D 2240/55* (2013.01)

(58) Field of Classification Search
CPC ..... F01D 11/001; F01D 9/04
See application file for complete search history.

(56) References Cited

U.S. PATENT DOCUMENTS 5,351,971 A * 10/1994 Short ..... F16J 15/3288 277/355
2009/0096138 A1 4/2009 Meier
2014/0105725 A1 4/2014 Stiehler
2015/0322808 A1* 11/2015 Wulf ..... F01D 11/001 277/414
2016/0040555 A1 2/2016 Hayford et al.
(Continued)

FOREIGN PATENT DOCUMENTS

DE 102012201050 A1 7/2013
DE 102013209746 A1 11/2014
(Continued)

OTHER PUBLICATIONS

"Material characterization in additive manufacturing using optical tomography" Symposium Non-destructive material characterization 2017 Berlin, MTU Aero Engines AG, Munich, Germany.
(Continued)

*Primary Examiner* — Woody A Lee, Jr.
(74) *Attorney, Agent, or Firm* — Barlow, Josephs & Holmes, Ltd.

(57) ABSTRACT

The present invention relates to a module for a turbomachine, having a guide vane arrangement and a seal carrier, which is arranged, with reference to a longitudinal axis of the module, radially inside an inner platform of the guide vane arrangement, wherein, in each case with reference to the longitudinal axis of the module, when considered in an axial section, the seal carrier has a radially extending seal carrier wall and a sealing web extending axially away from it, which forms a labyrinth seal together with the inner platform of the guide vane arrangement, wherein the seal carrier wall and the sealing web are made up in one piece with each other, i.e., they are built up additively together.

14 Claims, 3 Drawing Sheets

(56) References Cited

U.S. PATENT DOCUMENTS

| | | | | |
|---|---|---|---|---|
| 2016/0377087 | A1* | 12/2016 | Jakimov | F16J 15/444<br>415/148 |
| 2017/0167279 | A1* | 6/2017 | Kirby | C04B 41/52 |
| 2018/0340435 | A1* | 11/2018 | Schlemmer | F01D 11/001 |
| 2020/0025018 | A1* | 1/2020 | Schlemmer | F01D 11/001 |
| 2020/0132198 | A1* | 4/2020 | Schleif | B22F 3/1115 |

FOREIGN PATENT DOCUMENTS

| | | | | |
|---|---|---|---|---|
| DE | 102013212465 | A1 | 12/2014 | |
| DE | 102014208801 | A1 | 11/2015 | |
| EP | 1148209 | A2 | 10/2001 | |
| EP | 2360352 | A2 * | 8/2011 | F01D 11/001 |
| EP | 2360352 | A2 | 8/2011 | |
| EP | 2722486 | A1 | 4/2014 | |
| EP | 2818643 | A1 | 12/2014 | |
| EP | 3290649 | A1 | 9/2016 | |
| EP | 3109520 | A1 | 12/2016 | |
| GB | 2110768 | A | 6/1983 | |

OTHER PUBLICATIONS

Progress in Materials Science 74 (2015) 332-400, "Bioinspired engineering of honeycomb structure—Using nature to inspire human innovation", Zhang et al., Jul. 7, 2015.

* cited by examiner

ADDITIVELY MANUFACTURED MODULE FOR A TURBOMACHINE

BACKGROUND OF THE INVENTION

Technical Field

The present invention relates to a module for a turbomachine.

PRIOR ART

The turbomachine may involve, for example, a jet engine, e.g., a turbofan engine. Functionally, turbomachines are divided into compressor, combustion chamber, and turbine. Roughly, in the case of the jet engine, aspirated air is compressed by the compressor and is burned in the downstream combustion chamber with fuel mixed therewith. The hot gas that arises, a mixture of combustion gas and air, flows through the downstream turbine and is thereby expanded. In this case, the turbine withdraws the hot gas, and also energy in proportion, in order to drive the compressor. The turbine and the compressor are usually each constructed with multiple stages, wherein, in each case, a stage has a ring of guide vanes and a ring of rotating blades. In the case of the turbine, the rotating blade ring is arranged each time downstream to the guide vane ring.

The present invention has for a subject a module with a guide vane arrangement and a seal carrier. The guide vanes of the guide vane arrangement extend radially between a radially external outer platform and a radially internal inner platform. The seal carrier is arranged radially inside this inner platform; it forms a part of the so-called Inner Air Seal (IAS). The seal carrier helps to reduce or prevent gas losses, which is of advantage for the efficiency of the turbomachine. A portion that is as large as possible or, insofar as this is possible, the entire fluid or gas should flow through the gas channel of the turbomachine.

SUMMARY OF THE INVENTION

The present invention is based on the technical problem of providing a particularly advantageous module for a turbomachine.

This is achieved according to the invention by a module according to claim 1. The seal carrier thereof has a sealing web that forms a labyrinth seal. The sealing web is arranged on a seal carrier wall, which in turn extends radially. The sealing web extends out from the latter, either axially toward the front (facing upstream, with respect to the gas in the gas channel) or axially toward the back (downstream). The labyrinth seal is formed by the sealing web together with the inner platform of the guide vane arrangement and additionally, depending on the case, either the inner platform of a rotating blade arrangement placed directly in front upstream or one placed directly in back downstream; see also the axial section according to FIG. 2 for illustration.

In the seal carrier according to the invention, the seal carrier wall and the sealing web are or will be built up together in a generative or additive manner; they are made up in one piece with one another as an additively constructed part and thus cannot be separated from one another in a nondestructive manner. The seal carrier wall and the sealing web are manufactured on the basis of a data model by selective solidifying in regions of an initially shapeless material or a material of neutral shape (see below in detail), which is also designated 3D-printing. For example, in comparison to a separate manufacture of the seal carrier wall as a cast part and the sealing web as sheet metal with a subsequent joining, e.g., by riveting, the additive manufacture can already help to reduce effort and costs. In comparison to riveting, the one-piece configuration according to the invention can also be of advantage with respect to durability and reliability. The inventors have determined that vibrations can be introduced into a corresponding rivet by way of the sealing web, which, as a consequence, can lead to material fatigue. The rivet/rivet head or the sealing web could therefore loosen and cause considerable damage.

Preferred embodiments are found in the dependent claims and in the entire disclosure, wherein, in the presentation of the features, differentiation is not always made individually between the module and the turbomachine or the corresponding method or uses. The disclosure is to be read with respect to all claim categories. Thus, for example, if a module manufactured in a specific way is described, this is also to be read as the disclosure of a corresponding manufacturing process, and vice versa.

The sealing web has its axial extent or dimension when considered in an axial section; in this case, however, it need not necessarily exclusively extend axially. A proportional extent additionally in the radial direction may in fact be preferred; the sealing web can thus be oblique to the longitudinal axis of the module and/or can be provided with steps; see also the exemplary embodiment for illustration. With a corresponding shaping, the sealing web, on the one hand, can be optimized for the functionality of "labyrinth seal", whereby, on the other hand, the additive manufacture advantageously makes accessible a great geometrical diversity.

Also, in general, the seal carrier wall need not extend exclusively radially in the axial section. This is preferred, however; the seal carrier wall thus preferably extends perpendicular to the longitudinal axis of the module. Insofar as the extent of the seal carrier wall or the sealing web is generally described, for example, this refers to the surface extent of the respective component or region; thus, in this respect, the particular thickness remains out of consideration. For illustration: In FIG. 2, the seal carrier wall has it surface extent in the radial direction; the thickness is taken axially.

In general, in the scope of this disclosure, "axially" or "axial direction" refers to the longitudinal axis of the module, thus the longitudinal axis of the turbomachine. This longitudinal axis may coincide with an axis of rotation, for example, about which the rotating blades associated with the guide vane arrangement rotate during operation. "Radially" refers to radial directions that are perpendicular thereto and are directed away from the longitudinal axis, and the "circulation" or "direction of circulation" refers to a rotation around the longitudinal axis. The description of the seal carrier according to the main claim refers to an axial section, thus consideration in a sectional plane containing the longitudinal axis of the module. The depicted components or regions, of course, additionally have an extent in the direction of circulation, wherein a rotationally symmetric structure may be preferred in this respect.

"A" and "one" are to be read in the scope of this disclosure, unless explicitly stated otherwise, as an indefinite article and thus always also as "at least one." The seal carrier can thus also have yet another sealing web, for example, which is in fact preferred (see below). In general, a plurality of sealing webs is also conceivable; these extend axially away from the seal carrier wall in the same direction (to the front or to the back); in this case, however, they are radially displaced relative to one another. Preferably provided is a sealing web that extends on the remaining seal carrier axially to the front and a sealing web that extends axially to the back; most preferably, there is exactly one in each case.

In a preferred embodiment, the sealing web has a thickness that varies over its axial extent. The thickness of the sealing web is taken perpendicular to its surface extent; according to this variant, the sealing web can not only be shaped in steps, etc., but can be thickened and/or thinned locally, for example. As this varying thickness is realized in the individual case, for example, structural or vibrational mechanical simulations may be designed resulting in the effect that intrinsic frequency excitations can be minimized or suppressed by the varying thickness. Preferably, one or a plurality of local thicknesses can be provided. A particular shaping that is possible due to the additive manufacture thus, for example can help to reduce a load profile (introduction of vibrations) that was discussed initially in the context of a rivet failure.

In a preferred embodiment, the seal carrier wall has a varying thickness over its radial extent. The thickness is taken perpendicular to the surface extent of the seal carrier wall; in the case of the seal carrier wall preferably perpendicular to the longitudinal axis, it is taken in the axial direction. The thickness can or will be able to be adapted as a function of the force input based on structural mechanical simulations or optimizations. The thickness can increase, for example, from radially outside to radially inside over at least a section.

In general, the seal carrier preferably does not take on only a sealing function, but also a mechanical support function. For this purpose, the guide vane arrangement has one or a plurality of guide pins, which are arranged inside at the inner platform radially opposite to the guide vanes. These guide pins form a so-called spoke centering, and for this purpose, engage in a recess of the seal carrier that is open radially outward and that is bounded axially by the seal carrier wall. A sliding piece is arranged in this recess and the guide pin or guide pins is or are applied to this sliding piece in the direction of circulation.

In a preferred embodiment, this sliding piece is formed in one piece with the seal carrier wall, i.e., the two are additively built up together. This can be of advantage in the sense that, since the sliding piece then does not need to be manufactured/fastened separately as an integral part, for example, here also no riveting is necessary. If, in contrast, a separate sliding piece is set in the recess bounded by the seal carrier wall, it must usually have a somewhat under-dimensioning (in this way, it can be brought into its mounting position between the one or more seal carrier walls). During the riveting itself, the walls are then pressed together somewhat axially prior to closing the rivet, whereby, inversely, an initial stressing of the rivet can result after the removal of the riveting tool (pre-stressing due to the spring effect of the seal carrier walls). This problem can be avoided by the one-piece configuration.

In a preferred configuration, the first guide pin, together with a second guide pin, surrounds the sliding piece with reference to the direction of circulation. The sliding piece is thus held circumferentially between the guide pins, for which reason this arrangement is also referred to as Tang ("tongs"). In this case, the guide pins and the sliding piece can still slide radially relative to one another. The two guide pins find their respective attachment onto lateral surfaces of the sliding piece that are circumferentially opposite; this arrangement represents a spoke centering.

In a preferred configuration, the seal carrier wall, together with another seal carrier wall, forms a U profile, when considered in an axial section. The seal carrier walls, which can also be referred to as partition walls, each have their surface extent preferably radially and in the direction of circulation; their respective thickness is taken axially. Preferably, the seal carrier walls lie parallel relative to one another and each is perpendicular to the longitudinal axis (with reference to their surface extent).

In a preferred configuration, the sliding piece is formed in one piece with both seal carrier walls. This is not absolutely necessary in general, however; the sliding piece could also be provided in one piece only with one of the seal carrier walls; the other seal carrier wall could then be executed, for example, as sheet metal. Likewise, the two seal carrier walls could also each be manufactured additively and thus be multiple parts relative to each other.

In a preferred embodiment, the seal carrier has another sealing web that extends axially opposite to the first sealing web. In general, a variant is also conceivable, in which the sealing webs are arranged on the same seal carrier wall, thus one of the sealing webs on the front side thereof, and the other on the back side (each with reference to the axial direction). A variant having two seal carrier walls is preferred, wherein one sealing web is arranged on the axially front wall and extends axially toward the front, and the other sealing web is arranged on the axially back wall and extends axially toward the back.

In a preferred embodiment, the other sealing web is also constructed in one piece with the corresponding seal carrier wall; the two are therefore built up additively together. Preferably, the entire unit is or will be additively built up together from the two seal carrier walls, on each of which a sealing web is arranged (thus in the same process).

In a preferred embodiment, the seal carrier has a seal element radially inside. This element generally can also be produced separately, for example, and can be fastened to the seal carrier, e.g., in the case of a so-called brush seal. Independently from the configuration of the individual parts, the seal element arranged radially inside then seals to form a sealing structure, which rotates during operation together with the shaft or the rotating blades.

In a preferred embodiment, the seal element is provided as a so-called honeycomb seal; thus, when considered in the radial direction, it has a honeycomb shape. Such a seal element is also referred to as a run-in coating.

In a preferred embodiment, the seal element, in particular, the honeycomb seal is provided in one piece with the seal carrier wall, i.e., is thus built up additively together therewith. A completely integral seal carrier, i.e., one that is built up additively in its entirety, thus may be particularly preferred. In this case, of course, the run-in seal need not have a honeycomb shape in a strictly mathematical sense, but the degrees of freedom of the additive manufacture can also be utilized in this respect for adapting or optimizing the shape.

The invention also relates to a turbomachine having a module that has been presently disclosed. In general, the module is preferably a turbine module or a section of the turbine.

As already mentioned, the invention also relates to a method for manufacturing a presently disclosed module, wherein the seal carrier wall and the sealing web are additively built up together. The two are thus additively manufactured in the same process. The other parts discussed in the preceding (sliding piece, etc.) are also preferably produced additively in the same process. Reference is made expressly to the preceding disclosure. Particularly preferred, the entire seal carrier will be additively manufactured (all parts in the same process).

The additive buildup is produced in a preferred configuration in a powder bed process. The corresponding material, titanium aluminide, for example, is thus applied layer by layer sequentially in powder form, wherein a region that is determined in advance in each layer is solidified selectively based on the data model (the component geometry). Solidifying takes place by way of a melting by means of a radiation source, whereby in general, for example, an electron beam source is also conceivable. Preferably, melting is conducted with a laser source, thus a laser beam; therefore, the additive buildup is a selective laser melting (SLM).

BRIEF DESCRIPTION OF THE DRAWINGS

The invention will be explained in more detail in the following, on the basis of an example of embodiment, wherein the individual features, in the scope of the independent or coordinated claims, may also be essential to the invention in other combinations, and also, further, no distinction is made individually between the different claim categories.

Taken individually.

DESCRIPTION OF THE INVENTION

Figure 1:
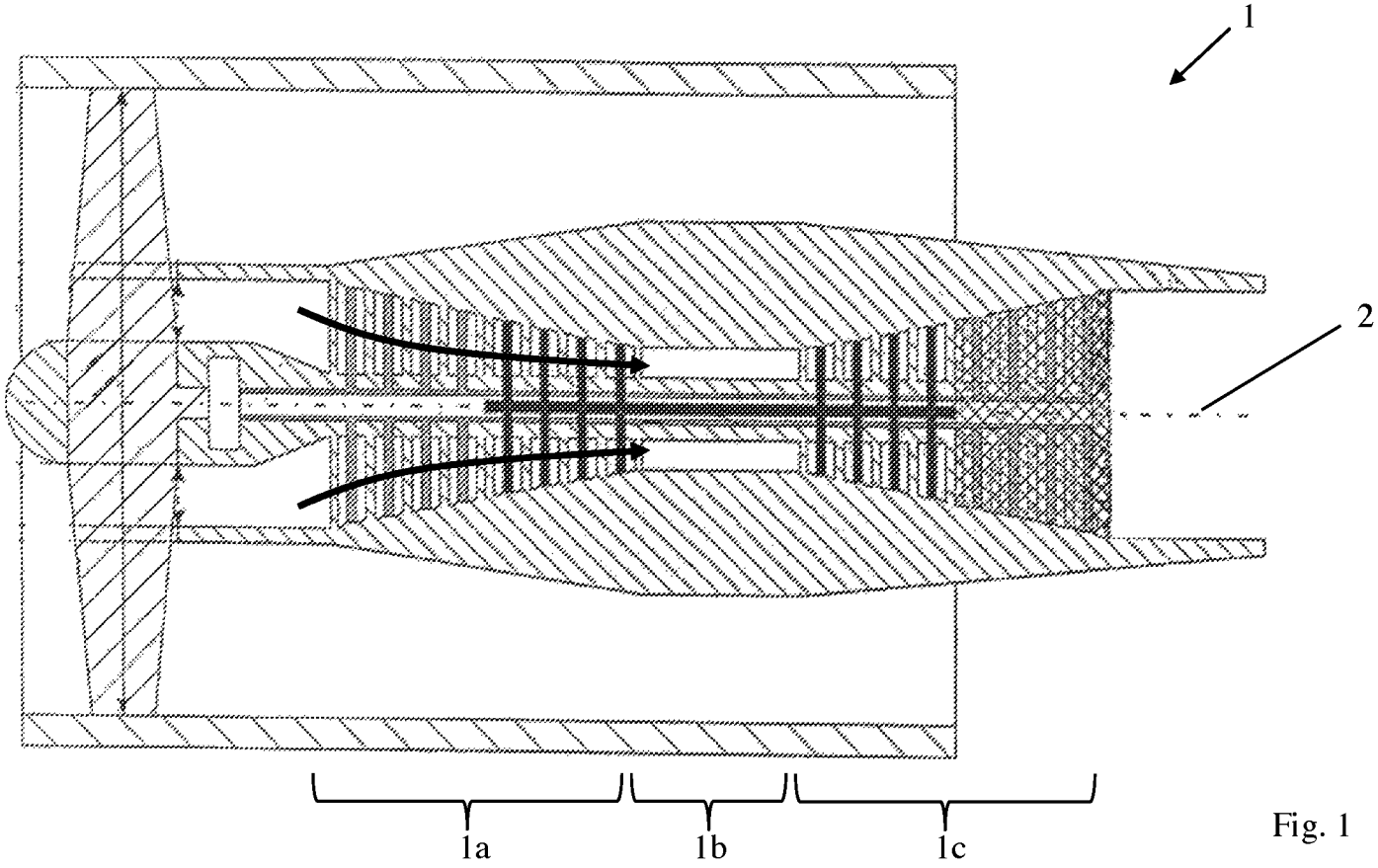
FIG. 1 shows a jet engine in an axial section.

FIG. 1 shows a turbomachine 1 in a schematic view, concretely, a jet engine. The turbomachine 1 is divided functionally into compressor 1*a*, combustion chamber 1*b*, and turbine 1*c*. In this case, both the compressor 1*a* as well as the turbine 1*c* are each constructed from a plurality of stages, each stage being assembled from a guide vane ring and a rotating blade ring. In the case of turbine 1*c*, the rotating blade ring is arranged each time downstream from the associated guide vane ring. During operation, the rotating blades rotate around the longitudinal axis 2.

Figure 2:
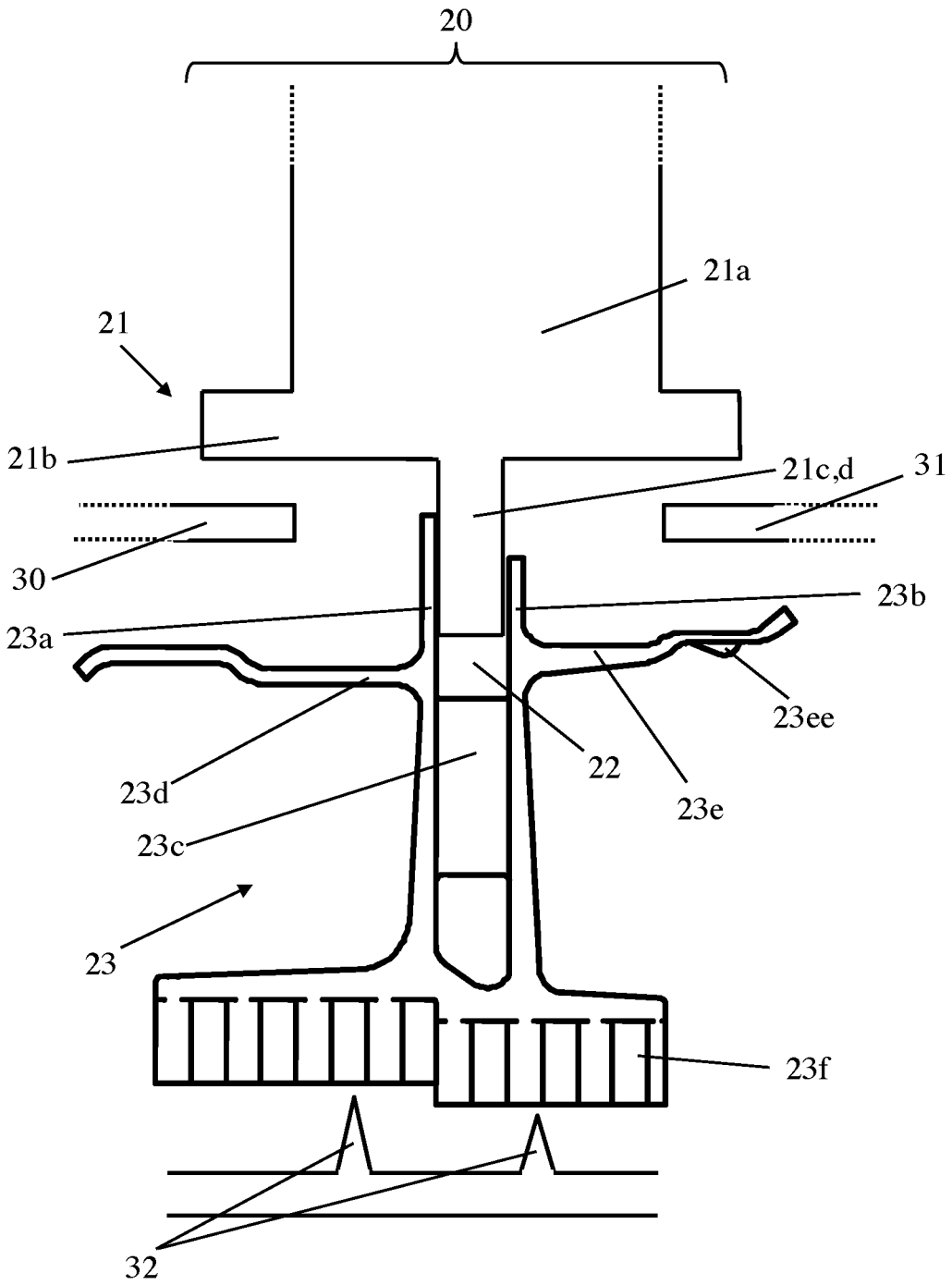
FIG. 2 shows, as part of a turbine stage, a guide vane arrangement with a suspension on a seal carrier, again in an axial section.

FIG. 2 shows, as a module 20, a section of the turbine 1*c*, again in an axial section. Concretely, a guide vane arrangement 21 with a guide vane 21*a*, an inner platform 21*b*, as well as a first and a second guide pin 21*c, d* can be recognized. The guide vane 21*a* is arranged radially outside on the inner platform 21*b*; the guide pins 21*c, d* are arranged radially inside. The guide pins 21*c, d* extend radially inward into a recess 22, which is formed by the seal carrier 23. Concretely, the recess 22 is bounded axially between a front seal carrier wall 23*a* and a back seal carrier wall 23*b* of the seal carrier 23; the two walls 23*a, b* of the seal carrier 23 form a U profile opening radially outward in the axial section. Radially inside, the seal carrier 23 has a seal element 23*f*, namely a honeycomb seal.

The guide pins 21*c, d* are held in position axially between the walls 23*a, b*; in this case, they can still be displaced radially, however; thus, they are not clamped. In detail, the plane of section of the axial section according to FIG. 2 lies circumferentially between the two guide pins 21*c, d*. In the following, therefore, in addition, reference is made also to FIG. 3, from which it can be seen how the guide pins 21*c, d* (indicated by the dashes) together surround a sliding piece 23*c* with reference to a direction of circulation 35. This arrangement, which is also referred to as Tang forms the so-called spoke centering, which still permits a certain radial displacement (for equilibrating thermally induced expansions of different magnitude during operation). The guide pins 21*c, d* run together radially outward in a fork shape, so to speak, which can be seen in the section according to FIG. 3.

Figure 3:
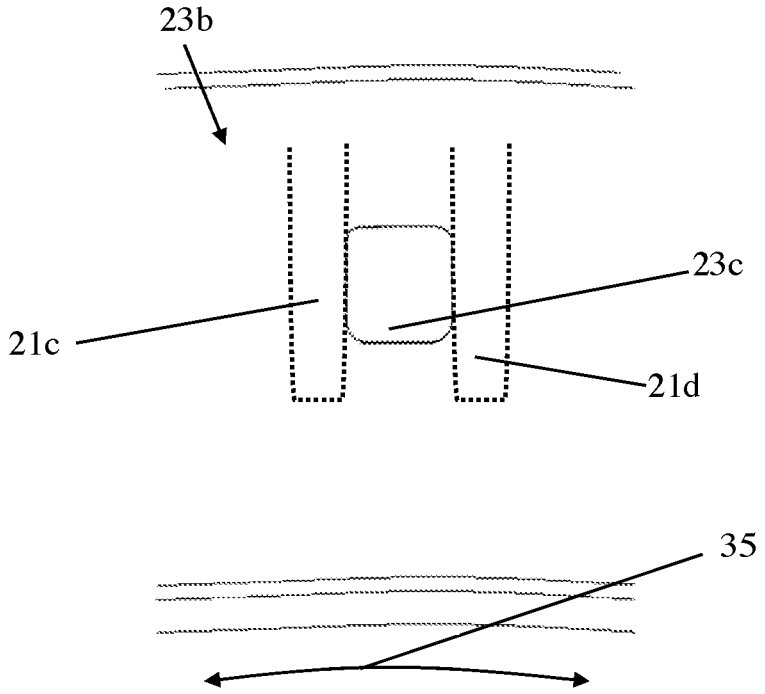
FIG. 3 shows the seal carrier according to FIG. 2 sectioned perpendicular to the longitudinal axis.

FIG. 3 shows a sectioned axial view; the sectional plane lies perpendicular to the longitudinal axis 2 and divides the recess 22 centrally. The front wall 23*a* lies outside the plane of section; the view falls on the back wall 23*b* of the seal carrier 23. The sliding piece 23*c* is formed in one piece with the seal carrier walls 23*a, b*, i.e., therefore, built up together in a powder bed process by means of SLM.

Further, the front sealing web 23*d* in FIG. 2 and the back sealing web 23*e* are also built up together in the manufacture. This is true also for the seal element 23*f* provided radially inside, which is provided in the form of a honeycomb seal. The entire assembly is thus built up additively layer by layer; the individual components are thus made in one piece with each other. This may be of interest with respect to the manufacture (fewer individual parts, lower expense); in particular, however, the durability and reliability are of advantage. Reference is made explicitly to the presentation in the introduction to the description.

Together with the inner platform 21*b* of the guide vane arrangement 21, the sealing webs 23*d, e* each form a labyrinth seal. In the case of the axially front sealing web 23*d*, the labyrinth seal is formed in common with a back edge 30 of the inner platform of the upstream rotating blade ring; in the case of the axially back sealing web 23*e*, it is formed in common with a front edge section 31 of the inner platform of the downstream rotating blade ring. In this case, the back edge section or front edge section 30, 31 is arranged radially between the respective sealing web 23*d, e* and the inner platform 21*b* of the guide vane arrangement 21; this structure is also referred to as a "fish mouth seal".

The seal element 23*f* seals against sealing structures 32, which rotate together with the shaft or the rotating blades. This arrangement with the seal carrier 23 is also referred to as an Inner Air Seal. Thus, overall, radial losses from the hot gas channel can be reduced or suppressed.

As can be seen further from FIG. 2, the seal carrier walls 23*a, b* have a varying thickness over their radial extent (increasing from radially outside to radially inside). This varying thickness, which can be realized rather well due to the additive manufacture, is adapted to the force input (based on structural-mechanical simulations).

It is further seen from FIG. 2 that the thickness of the axially back sealing web 23*e* also varies. The thickness decreases first away from the seal carrier wall 23*b*; then the sealing web 23*e* is shaped locally with a thickening 23*ee*. This thickening 23*ee* serves for detuning; thus, it suppresses critical intrinsic frequency excitations. Likewise, of course, the axially front sealing web 23*d* can be shaped with variable thickness, which is not shown in detail.

What is claimed is:

1. A module for a turbomachine, comprising:

a guide vane arrangement; and a seal carrier, which is arranged radially inside an inner platform of the guide vane arrangement with respect to a longitudinal axis of the module;

wherein, with reference to the longitudinal axis of the module, when considered in an axial section, the seal carrier has a radially extending seal carrier wall and a sealing web, which form a labyrinth seal together with the inner platform of the guide vane arrangement, wherein the seal carrier forms a recess that is open radially outward and is bounded axially by the seal carrier wall, wherein a sliding piece is arranged in the recess, wherein the seal carrier wall, the sliding piece, and the sealing web are additively formed in one piece with each other.

2. The module according to claim 1, in which the sealing web has a varying thickness over its axial extent, when considered in the axial section.

3. The module according to claim 1, in which the seal carrier wall has a varying thickness over its radial extent, in the axial section.

4. The module according to claim 1, wherein the guide vane arrangement is retained in the recess by a first guide pin, which extends radially inward from the inner platform; the first guide pin of the guide vane arrangement is attached to the sliding piece, with reference to a circulation around the longitudinal axis of the module.

5. The module according to claim 4, in which a second guide pin is arranged radially inside on the inner platform, this second guide pin, together with the first guide pin being arranged in the recess of the seal carrier, wherein the second guide pin also is attached to the sliding piece, and the sliding piece is arranged between the first guide pin and the second guide pin with reference to the circulation.

6. The module according to claim 4, in which the seal carrier wall together with another seal carrier wall, forms the recess in a U profile shape, in the axial section.

7. The module according to claim 6, wherein the sliding piece and the other seal carrier wall are also additively formed in one piece with each other.

8. The module according to claim 1, wherein the seal carrier has another sealing web, which extends axially away from the remaining seal carrier, opposite to the first sealing web.

9. The module according to claim 8, wherein the other seal carrier wall and the other sealing web are additively formed in one piece with each other.

10. The module according to claim 1, wherein the seal carrier has a seal element radially inside thereof.

11. The module according to claim 10, wherein the seal element is a honeycomb seal.

12. The module according to claim 10, wherein the seal carrier wall and the seal element are additively formed in one piece with each other.

13. The module according to claim 1, wherein the module is configured and arranged in a turbomachine.

14. The module according to claim 1, wherein the seal carrier wall and the sealing web are built up together in a powder bed process.

* * * * *